United States Patent [19]

Sarin

[11] Patent Number: 4,527,931

[45] Date of Patent: Jul. 9, 1985

[54] INDEXABLE INSERT FOR MINING DRILL

[75] Inventor: Vinod K. Sarin, Lexington, Mass.

[73] Assignee: GTE Laboratories Incorporated, Waltham, Mass.

[21] Appl. No.: 499,003

[22] Filed: May 27, 1983

[51] Int. Cl.[3] ..... E21B 10/62; B23B 27/16

[52] U.S. Cl. ..... 407/113; 175/383; 175/410; 408/188; 408/713

[58] Field of Search ..... 175/410, 383, 413, 417, 175/418, 415; 408/239 R, 227, 228, 229, 231, 188, 713; 407/113, 114, 40, 42, 47, 48, 96, 116; 403/327, 377

[56] References Cited

U.S. PATENT DOCUMENTS

| | | | |
|---|---|---|---|
| 2,276,771 | 3/1942 | Hawker | 408/227 |
| 2,641,479 | 6/1953 | Gabriele | 279/79 |
| 3,490,117 | 1/1970 | Hertel | 407/113 |
| 3,715,168 | 2/1973 | Kuhn | 408/239 R |
| 3,878,905 | 4/1975 | Schaumann | 175/383 |
| 3,966,350 | 6/1976 | Benjamin | 408/239 R |
| 4,115,024 | 9/1978 | Süssmuth | 407/114 |
| 4,355,932 | 10/1982 | Koppelmann | 408/188 |

FOREIGN PATENT DOCUMENTS

| | | | |
|---|---|---|---|
| 533659 | 3/1953 | Belgium | 407/113 |
| 80359 | of 1951 | Czechoslovakia | 408/239 |

*Primary Examiner*—James A. Leppink
*Assistant Examiner*—Hoang C. Dang
*Attorney, Agent, or Firm*—Robert E. Walter

[57] ABSTRACT

A removable and indexable insert includes forwardly and rearwardly projecting faces forming cutting edges with side surfaces and concave end surfaces forming side cutting edges.

1 Claim, 5 Drawing Figures

INDEXABLE INSERT FOR MINING DRILL

FIELD OF INVENTION

The present invention relates to an indexable insert for a mining drill which is particularly useful for drilling coal mine roof bolt holes.

BACKGROUND OF INVENTION

Roof drills are used for drilling holes in rock in the roof of mines for installing roof bolts. The drills are typically in the form of a drive body having a bit at the forward end with a hard wearresistant material, such as tungsten carbide rigidly secured to the bit.

U.S. Pat. No. 4,190,128 to Emmerich relates to a roof drill having openings in the bit which connect to a hole in the drive body for the passage of air and removal of detritus.

U.S. Pat. No. 3,032,129 to Fletcher et al relates to a drill bit wherein the air is drawn into the drive body through open portions on each side of the bit.

U.S. Pat. No. 3,434,552 to Bower, Jr. relates to a bit having a slot with a cutting insert loosely held within the slot for free endwise sliding movement relative to the slot.

U.S. Pat. No. 3,434,553 to Weller relates to a drill where the center insert socket is formed by notching the opposite sides of the tube at the end 13 and bending the tube end wall to form two straight side support walls 14 and an outwardly bowed portion 15 which forms a duct closed on one side by the outer inset. The insert may be held between the walls by brazing or by a pin 16.

U.S. Pat. No. 3,415,332 to Bower, Jr. relates to a drill bit where the tubular holder has a pair of transversely aligned slots within which a pair of flat narrow, elongated plates are mounted. A cutter bit is positioned between the plates and the entire assembly is held together by a pin passing through the tubular holder, the plates, and the bit.

SUMMARY OF INVENTION

The end of the drive body is typically configured to receive and support a cutter bit which includes a bit body having the insert brazed in a transverse groove. In the present invention, the insert is adapted to be removably secured directly to the drive body. Heretofore, in prior art configurations of this nature, plates and single pins have been utilized to hold the insert to the drive body producing a lose connection. In the present invention, the insert is adapted to be firmly but removably held in place by attachments at two positions. Additionally, the insert is configured to permit indexing and usage of both forwardly and rearwardly projecting cutting edges.

In accordance with the present invention, there is provided a removable and indexable insert for movement about an axis of rotation whereby leading insert surfaces are presented forward of trailing insert surfaces in the direction of rotation, said insert having forwardly projecting faces and rearwardly projecting faces, side surfaces extending intermediate end portions and intermediate said forwardly and rearwardly projecting faces, said faces forming cutting edges at the juncture with leading insert surfaces, each of said end portions having an axially aligned concave end surface intermediate respective side surfaces, forming side cutting edges at the juncture with said respective side surfaces.

DRAWINGS

DETAILED DESCRIPTION

Figure 1:
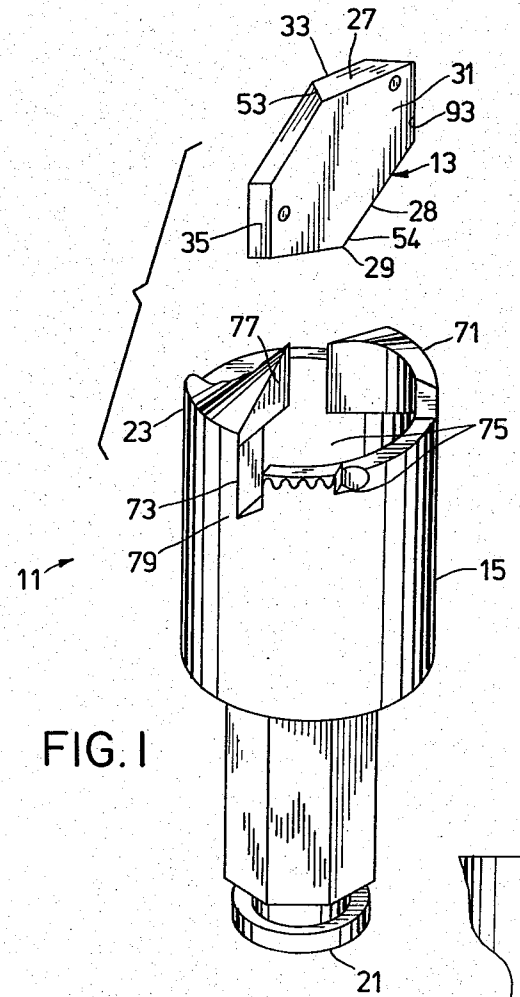
FIG. 1 is a perspective view of the drill including insert in assembly relationship.

FIG. 1 generally illustrates a mining drill 11 comprising an insert 13 mounted on a drive body 15 having an axial passage 17 for the flow of detritus from the cutting area. The insert 13 is formed from a hard material suitable for cutting rock. Typical materials are sintered cemented metal carbides. The drive body 15 is cylindrically shaped and capable of being mounted for movement about an axis of rotation 19. As illustrated in FIG. 1, and rearward end 21 has a hexagonal shape of reduced dimension forming a socket end which can be attached to another drive body having an air passage with a mating hexagonal recess. Multiple drive bodies can be conveniently connected to a drilling machine and vacuum source of a conventional type.

The terms forward and rearward are used for convenience of description and should not be taken as limiting the scope of the invention. For purposes of this description, forward generally refers to axial direction in which the drill is advanced during cutting and rearward is the opposite direction.

An insert 13 which is attached to the forward end 23 of the drive body 15 is detachably secured thereto for movement about the axis of rotation 19. The insert 13 includes a pair of forwardly projecting faces 27 and a pair of rearwardly projecting faces 28. Each of the faces 27, 28 slope toward the central body portion of the insert 13 toward the end portions 35 at an angle of about 17 to 22 degrees with respect to a plane normal to the axis of rotation 19. Side surfaces 31 extend from respective ends intermediate faces 28 and faces 27 and intermediate the end portions 35. The pair of forward faces 27 and pair of rearward faces 28 meet substantially at the axis of rotation 19 and slope away from the cutting edges 33 in opposite directions on either side of the point at an angle of about 8° to about 12°. The respective pairs of cutting edges 33 are located at two diagonally opposite corners of the rectangular base surface 29.

During rotation of the insert 13 during cutting, the cutting edges 33 lead the insert 13 during rotation so as to make primary contact with the work, i.e. roof rock. For purposes of this description, leading surfaces or edges are intended to refer to edges or surfaces which are first presented to the work in the direction of rotation.

The insert 13 is mounted so that end portions 35 extend in a radial direction outwardly of the drive body 15. Preferably the point 53 of the insert 13 is axially aligned with the axis of rotation 19 and the insert 13 is fixedly held in position. The radial projection of the end portions 35 beyond the drive body 15 creates a hole slightly larger than the drive body 15 dimensions. Thus, during drilling, air is supplied or drawn into the drill hole by suction along the exterior of the drive body 15.

The drive body 15 includes a pair of forwardly projecting flanges 71 forming diametrically opposed apertures 73. Each of the apertures 73 is adapted to receive one of the respective end portions 35. The flanges 71 which are diametrically opposed extend in a direction forward of the plane of the base surface 29 of the insert 13 when the insert 13 is mounted to the drive body 15. Each of the flanges 71 is spaced from a respective leading portion of a side surface 31 so as to form a respective air passage 75 adapted for the conveyance of detritus during drilling to the axial passage 17.

As illustrated in the drawings, outer surfaces of the flanges 71 are preferably an extension of the tubular shape of the drive body 15. In the area adjacent the cutting edges 33, the respective air passages 75 which are diametrically opposed are formed by respective insert surfaces 49 and the interior surface of the respective flanges 71.

Each flange 71 includes an insert engaging surface 77 facing a respective trailing portion of a side surface 31. The pair of insert engaging surfaces 77 disengagably transmits substantially all of the torsional forces to the insert 13 during drilling. The insert 13 is provided with a means independent of the means for applying torsional forces to removably hold the insert 13 from movement in a forward axial direction relative to the drive body 15.

The torque from the drive body 15 is transmitted to the insert 13 by engagement of a respective insert engaging surface 77 with a respective trailing side surface 31 of the insert 13. Each insert engaging surface 31 extends forwardly and along a plane corresponding to the plane of the side surface 31 so that sufficient surface is in engagement to transmit the torque. Each insert engaging surface 77 is a part of a respective flange and together form a slot which extends diametrically across the drive body 15 due to the radial extension of the insert engaging surfaces 77. Each of the insert engaging surfaces 77 are positioned in diagonally opposite sides of the slot so as to engage opposite side surfaces 31 of the insert 13 whereby leading insert surfaces are substantially unobstructed and trailing insert surfaces are engaged. The rearwardly projecting faces 19 of the insert 13 engage and is supported by a respective lower support surface 79 of a respective aperture 73 so that the rearward forces on the insert 13 during drilling caused by the forward thrust of the insert 13 against the work is transmitted to the drive body 15. The above description with respect to one aperture also applies to the other aperture due to similarity of construction. It is contemplated that a land may bridge the lower surfaces 79 to provide additional support surface.

The drive body 15 includes as an integral part a means for detachably securing the insert 13 to the drive body 15 so that the insert 13 remains in place when being withdrawn from the drill hole and easily changed when worn.

The detachable securing means comprises a pair protuberances 81 resiliently biased toward the insert engaging surface 77 for engagable holding an insert interpositioned the surface 77 and the detachable securing means within the slot. Each of the protuberances 81 is positioned exterior to the axial passage 17 on opposite sides thereof so as not to obstruct the passage. Each of the respective flanges 71 includes a respective seating surface 83 facing the insert engaging surface 77 of the other flange 71. As shown in the drawings, the protuberances 81 are biased away from the seating surface in a direction substantially normal to the axis of rotation by a spring 85 positioned in a borehole 87. The protuberance 81 includes an enlarged portion 89 interior, the borehole which seats against a restricted portion of the borehole to limit outward movement against the force of the spring. As an insert 13 is positioned in the slot formed by the flanges 71, the protuberances 81 move inwardly and are displaced by the surface of the insert 13.

The insert 13 which performs the cutting function of the drill includes cutting edges 33 which rotate about the axis 19. Side surfaces 31 extend in an axial direction in spaced relationships. Typically the surfaces 31 are substantially parallel. End portions 35 which extend in an axial direction form corners at the junctions with the side surfaces 31. The leading corners form side cutting edges 101. From a plane normal to the axis of rotation at the point 53, 54, each of the pairs of faces 27, 28 slope downwardly in two directions in a first direction normal to the axis 19 and in a second direction normal to the first direction and the axis 19. The juncture of one of the respective faces 27 with a respective leading side surface 31 forms a leading cutting edge 33 and the juncture of a respective leading face 27 with a trailing side surface 31 forms a trailing edge. A similar description applies with respect to faces 28.

The insert 13 includes indents 91 which receive the protuberances 81 for engageably holding the insert 31 in the slot formed by the flanges 71 with leading cutting edges 33 projecting forwardly of the slot and side cutting edges projecting outwardly of the slot. Each of the indents 91 is positioned inwardly from a side surface 31 on the respective leading insert surfaces so that each of the indents 91 is located on a respective side surface 31. Due to the outward biasing of the protuberances 81, the insert 13 is firmly held in place when the drill is withdrawn from a borehole. By varying the depth of the indent 91, the force required to remove the insert 13 in a forward axial direction from the slot can be adjusted. If the insert 13 is too easily removed, the depth of the indent 91 may be increased so that the protuberances 81 project into the indents 91 a greater distance and thus presenting greater resistance to removal of the insert 13. It is also contemplated that the spring 85 or resilient biasing means may be adjusted so that a greater or lesser force bears against the indents 91.

The rearward faces 28 are spaced from the forward faces 27 forms a juncture with the trailing portion of a respective side surface. The juncture is preferably beveled at a location which engages the protuberances 81 for permitting the installation of the insert. The beveled portion of the juncture is positioned in the axial direction spaced from the indent 91 so the protuberance rides over the beveled juncture prior to engaging the indent 91 during insertion of the insert.

Figure 4:
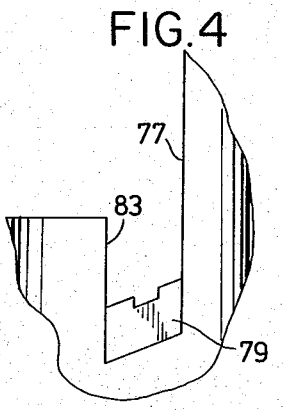
FIG. 4 is a partial enlarged view along 4—4.

FIG. 1, shows an indexable insert. On each of the sides 31, the cutting edges lie in diagonally opposed gradients with respect to the axis of rotation 19. The trailing edges lie in the other diagonally opposite gradients for each side. Due to the indexable feature, the diametrically opposite surfaces of each side become trailing or leading surface depending on position of the insert 13. The leading surface is associated with the cutting edge. The cutting edges project outwardly away from the center of the insert a greater distance than the trailing edges. Preferably the faces 27 or 28 which lie on one side of the axis of rotation 19 are substantially parallel. As illustrated in detail in FIG. 4, the drive body is provided with lower support surfaces 79 which match the slope of the faces 27 and 28. Each of the pair of support surfaces 79 slope downwardly from a plane normal to the axis 19 in two directions. In a radial direction from the interior of the drill body 15, a respective support surface 79 slopes upwardly along the axial direction. In a tangential direction, the respective support surfaces 79 slope downwardly from the seating surface 83 to the insert engaging surfaces 73.

Figure 3:
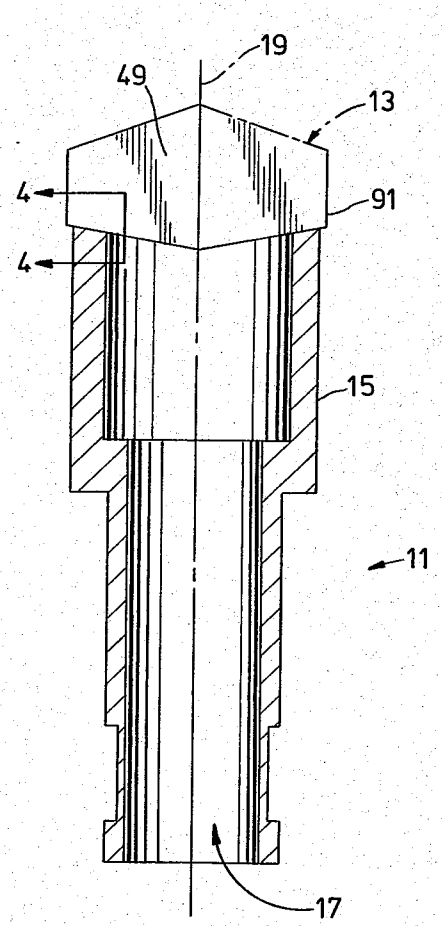
FIG. 3 is a side view of the drive body in section.
Figure 5:
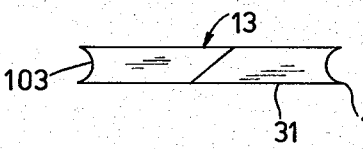
FIG. 5 is a top view of the insert.
Figure 2:
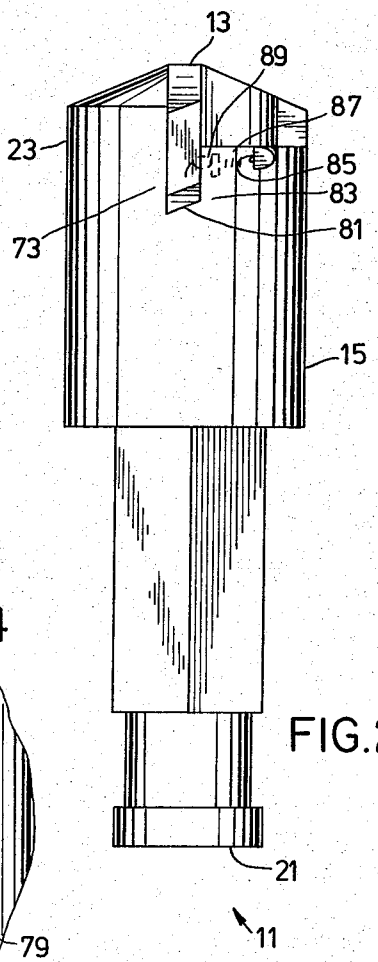
FIG. 2 is a side view of the drive body of FIG. 1.

As illustrated in detail in FIG. 5, each of the end portions 35 form cutting edges 101 with respective side surfaces 31. Depending on position of the insert 13 and direction of rotation, the leading corners formed at the junction of respective side surfaces 31 and end surfaces 103 become side cutting edges. In accordance with the principles of the present invention, the end surfaces 103 which extend in the axial direction are concave in the radial direction with respect to the axis of rotation 19 and an end view.

I claim:

1. A removable and indexable insert adapted for rotation about an axis comprising a pair of side surfaces being substantially parallel and extending in the axial direction, each side surface forming a leading insert surface and a trailing insert surface whereby said leading insert surface is presented forward of said trailing insert surface in the direction of rotation, a pair of faces projecting forwardly along the axial direction, a pair of faces projecting rearwardly along the axial direction, each face forming a cutting edge at the juncture with the leading insert surface of a respective side surface, a pair of end portions, each of said end portions having an axially aligned and concave end surface intermediate respective side surfaces forming side cutting edges at the juncture with respective side surfaces, each side surface including a pair of indents, each indent being positioned adjacent an end portion in a respective leading insert surface.

* * * * *